US008261398B2

(12) United States Patent
Haigh et al.

(10) Patent No.: US 8,261,398 B2
(45) Date of Patent: Sep. 11, 2012

(54) PAINT BRUSH WITH DETACHABLE HEAD

(75) Inventors: Christopher E. Haigh, Chicago, IL (US); Louis B. Schiesz, Fishers, IN (US); Clarence Wesley Headrick, III, Portland, OR (US)

(73) Assignee: Margco International, LLC, Indianapolis, IN (US)

( * ) Notice: Subject to any disclaimer, the term of this patent is extended or adjusted under 35 U.S.C. 154(b) by 664 days.

(21) Appl. No.: 11/923,986

(22) Filed: Oct. 25, 2007

(65) Prior Publication Data

US 2009/0049630 A1 Feb. 26, 2009

Related U.S. Application Data

(60) Provisional application No. 60/863,029, filed on Oct. 26, 2006.

(51) Int. Cl.
*B25G 3/12* (2006.01)
*A46B 7/04* (2006.01)

(52) U.S. Cl. ..... 15/145; 15/143.1; 15/144.1; 15/172; 15/176.1; 15/176.6; 16/422; 16/430; 16/900; 16/DIG. 24; 16/DIG. 41; 403/92; 403/93; 403/96; 403/97

(58) Field of Classification Search ..... 15/143.1, 15/144.1, 145, 172, 176.1, 176.6; 16/422, 16/430, 900, DIG. 24, DIG. 41; 403/92, 403/93, 96, 97
See application file for complete search history.

(56) References Cited

U.S. PATENT DOCUMENTS

| | | | | | |
|---|---|---|---|---|---|
| 555,854 | A | * | 3/1896 | Davenport | 15/144.1 |
| 727,035 | A | * | 5/1903 | Van Loan | 403/66 |
| D51,641 | S | | 1/1918 | Hargrave | |
| 1,787,970 | A | | 1/1931 | Bertola | |
| 2,032,664 | A | | 3/1936 | Raptis | |
| 2,066,328 | A | | 1/1937 | Cameron | |
| 2,147,310 | A | | 2/1939 | Morrison | |
| 2,175,278 | A | * | 10/1939 | Orebaugh | 15/172 |
| 2,389,882 | A | | 11/1945 | Wood, Jr. | |
| 2,395,245 | A | * | 2/1946 | Booharin | 15/144.2 |
| 2,526,756 | A | | 10/1950 | Krebs | |
| 2,528,599 | A | | 11/1950 | Loether | |
| 2,558,290 | A | | 6/1951 | Brown, at al. | |
| D167,775 | S | | 9/1952 | Schmidt | |
| 2,617,142 | A | | 11/1952 | Cadwell et al. | |
| 2,633,589 | A | | 4/1953 | Eisner et al. | |
| 2,712,765 | A | | 7/1955 | Knight, Jr. | |
| 2,719,998 | A | * | 10/1955 | Hibbs | 15/172 |
| 2,817,107 | A | | 12/1957 | Zellinger | |

(Continued)

FOREIGN PATENT DOCUMENTS

BE 497801 12/1950

(Continued)

OTHER PUBLICATIONS

U.S. Appl. No. 12/556,395, Haigh et al., Sep. 9, 2005, Office Action dated Nov. 5, 2010.

(Continued)

*Primary Examiner* — Mark Spisich
(74) *Attorney, Agent, or Firm* — Krieg DeVault LLP

(57) ABSTRACT

A paint brush has a handle and a paint brush head. The paint brush head is detachable from the paint brush handle. The paint brush head may be rotatable to a number of positions relative to the paint brush handle.

19 Claims, 8 Drawing Sheets

U.S. PATENT DOCUMENTS

| | | | | | |
|---|---|---|---|---|---|
| 2,838,835 | A | | 6/1958 | Jepson | |
| 2,910,770 | A | | 11/1959 | Kachline | |
| 3,027,582 | A | | 4/1962 | Pittman | |
| D199,520 | S | | 11/1964 | Jones | |
| 3,273,192 | A | | 9/1966 | Mazzella | |
| 3,353,203 | A | * | 11/1967 | Ginter | 15/244.1 |
| 3,367,578 | A | | 2/1968 | Juvinall et al. | |
| D212,668 | S | | 11/1968 | Miller | |
| 3,498,546 | A | | 3/1970 | Valdespino | |
| 3,548,593 | A | | 12/1970 | Valdespino | |
| 3,596,304 | A | | 8/1971 | Welt | |
| 3,673,684 | A | | 7/1972 | Muntz | |
| 3,717,896 | A | * | 2/1973 | Chase et al. | 15/210.1 |
| 3,737,187 | A | * | 6/1973 | Pryor | 294/19.1 |
| 3,757,376 | A | | 9/1973 | Coombes | |
| 3,866,257 | A | | 2/1975 | Cansdale, Sr. | |
| 3,874,021 | A | | 4/1975 | Jacobs | |
| 3,893,242 | A | | 7/1975 | Lieb et al. | |
| D240,678 | S | | 7/1976 | Herig | |
| 4,018,076 | A | | 4/1977 | Wagner | |
| RE29,311 | E | | 7/1977 | Ritter | |
| D255,845 | S | | 7/1980 | Wood | |
| 4,311,404 | A | | 1/1982 | Kodera | |
| D269,588 | S | | 7/1983 | Ludwig | |
| 4,469,223 | A | | 9/1984 | Smith | |
| 4,494,268 | A | | 1/1985 | Chu | |
| D279,254 | S | | 6/1985 | Smith et al. | |
| 4,577,367 | A | | 3/1986 | Durand | |
| 4,621,770 | A | | 11/1986 | Sayen | |
| 4,658,461 | A | | 4/1987 | Roe et al. | |
| 4,819,294 | A | | 4/1989 | Calvert | |
| D303,921 | S | | 10/1989 | Blochlinger et al. | |
| 4,936,702 | A | | 6/1990 | Hsu | |
| 4,956,892 | A | | 9/1990 | Fawkes | |
| 5,207,755 | A | | 5/1993 | Ampian | |
| 5,226,198 | A | | 7/1993 | Martin | |
| 5,366,314 | A | | 11/1994 | Young | |
| 5,375,286 | A | | 12/1994 | Harrah | |
| 5,499,637 | A | | 3/1996 | Foti | |
| 5,502,859 | A | | 4/1996 | Kim | |
| 5,520,073 | A | | 5/1996 | Bakula et al. | |
| D371,002 | S | | 6/1996 | Berti | |
| 5,577,654 | A | | 11/1996 | Bishop | |
| 5,638,577 | A | | 6/1997 | Gooding et al. | |
| D388,684 | S | | 1/1998 | Irwin | |
| 5,752,619 | A | | 5/1998 | Fulton | |
| 5,802,658 | A | * | 9/1998 | Ward | 15/144.2 |
| 5,902,065 | A | | 5/1999 | Forestiero et al. | |
| 5,903,952 | A | * | 5/1999 | Camp et al. | 15/230.11 |
| 5,926,903 | A | | 7/1999 | Kim | |
| D413,445 | S | | 9/1999 | deBlois et al. | |
| D413,784 | S | | 9/1999 | Tsai | |
| D414,672 | S | | 10/1999 | Tsai | |
| D416,390 | S | | 11/1999 | Corriveau | |
| 5,992,423 | A | * | 11/1999 | Tevolini | 132/200 |
| 6,029,307 | A | | 2/2000 | Baudoin | |
| 6,035,481 | A | | 3/2000 | Douglas et al. | |
| D429,072 | S | | 8/2000 | Winge | |
| 6,119,311 | A | * | 9/2000 | Lavallee | 16/436 |
| D432,891 | S | | 10/2000 | Sterling | |
| 6,138,313 | A | | 10/2000 | Barton et al. | |
| 6,148,467 | A | * | 11/2000 | Martinsson | 15/172 |
| D439,334 | S | | 3/2001 | Hershberger et al. | |
| 6,213,667 | B1 | | 4/2001 | Isaac | |
| 6,230,357 | B1 | | 5/2001 | Davis | |
| 6,230,716 | B1 | * | 5/2001 | Minoletti | 132/226 |
| 6,262,693 | B1 | | 7/2001 | Sutter et al. | |
| 6,301,740 | B1 | * | 10/2001 | Quiroz | 15/172 |
| 6,345,406 | B1 | | 2/2002 | Dodd | |
| 6,363,578 | B1 | | 4/2002 | Chang | |
| 6,408,479 | B1 | * | 6/2002 | Pinney | 15/230.11 |
| D459,645 | S | | 7/2002 | Rothfus et al. | |
| 6,438,784 | B1 | | 8/2002 | Yu | |
| 6,438,797 | B1 | | 8/2002 | Thomas | |
| 6,473,929 | B1 | | 11/2002 | Learned, III | |
| D468,618 | S | | 1/2003 | Ho | |
| 6,502,585 | B1 | * | 1/2003 | Mazzei et al. | 132/237 |
| 6,510,578 | B1 | * | 1/2003 | Cyr et al. | 15/176.6 |
| 6,546,585 | B1 | | 4/2003 | Blaustein et al. | |
| D474,949 | S | | 5/2003 | Schaffield et al. | |
| 6,557,212 | B2 | | 5/2003 | Huang | |
| 6,681,436 | B2 | | 1/2004 | Nilsson | |
| D495,145 | S | | 8/2004 | Gladden | |
| D501,324 | S | | 2/2005 | Berti | |
| 6,880,253 | B1 | | 4/2005 | Gyllerstrom | |
| D527,531 | S | | 9/2006 | Fruin | |
| D544,331 | S | | 6/2007 | Blehm | |
| D565,920 | S | | 4/2008 | Bagley | |
| D578,771 | S | | 10/2008 | Bagley | |
| 7,472,447 | B2 | | 1/2009 | Lougheed | |
| 2001/0025421 | A1 | | 10/2001 | Damstra | |
| 2002/0148058 | A1 | | 10/2002 | Greenwood et al. | |
| 2002/0178586 | A1 | | 12/2002 | Oswald | |
| 2003/0005533 | A1 | | 1/2003 | Woodnorth et al. | |
| 2003/0217424 | A1 | | 11/2003 | Stone | |
| 2003/0221318 | A1 | | 12/2003 | Iwashita et al. | |
| 2004/0083865 | A1 | | 5/2004 | Stevens | |
| 2004/0178223 | A1 | | 9/2004 | Foster et al. | |
| 2004/0231083 | A1 | | 11/2004 | Zaksenberg | |
| 2006/0037162 | A1 | * | 2/2006 | McRay | 15/202 |
| 2007/0157406 | A1 | * | 7/2007 | Kim | 15/172 |
| 2007/0251041 | A1 | * | 11/2007 | Errichiello et al. | 15/172 |
| 2007/0294849 | A1 | | 12/2007 | Bagley | |

FOREIGN PATENT DOCUMENTS

| | | | |
|---|---|---|---|
| DE | 916406 | | 8/1954 |
| DE | 19742286 | * | 4/1998 |
| DE | 19837988 | * | 2/2000 |
| DE | 10006788 | * | 8/2001 |
| EP | 640303 | * | 3/1995 |
| FR | 714282 | | 11/1931 |
| FR | 894974 | | 3/1944 |
| FR | 2428418 | | 11/1980 |
| FR | 2624766 | | 6/1989 |
| GB | 606536 | | 12/1945 |
| GB | 886285 | | 5/1958 |
| GB | 2259474 | * | 3/1993 |
| GB | 2301307 | * | 12/1996 |
| GB | 2381189 | * | 4/2003 |
| GB | 2403448 | * | 1/2005 |
| IT | 429280 | | 3/1947 |

OTHER PUBLICATIONS

International Bureau of WIPO, International Preliminary Report, PCT/US2008/078045, Apr. 27, 2010.

International Search Report, PCT/US2008/078045, Margco International, LLC, Dec. 2, 2008, International Searching Authority, United States.

* cited by examiner

PAINT BRUSH WITH DETACHABLE HEAD

RELATED APPLICATIONS

This application is related to U.S. Provisional Application No. 60/863,029, filed on Oct. 26, 2006, incorporated herein by reference.

FIELD OF THE INVENTION

This invention relates to a paint brush, and more particularly to a paint brush having a detachable paint brush head.

BACKGROUND OF THE INVENTION

Paint brushes are well known and are useful in a number of applications. However, once a common paint brush is used, it is typically necessary to either clean the paint off of the paint brush, or in the alternative, throw the paint brush away.

Moreover, the common paint brush is typically formed so that the handle is in the same plane (i.e. axially aligned) with the brush head. While this alignment may be suitable for some uses, it can be limiting and not as suitable or comfortable for a user in other uses.

SUMMARY OF THE INVENTION

The present invention relates to a paint brush that has a handle and a detachable paint brush head. The handle can be formed for comfort in a user's hand, such as being contoured to fit in a person's palm and have contoured portions for receiving the fingers of the person. The handle could also be formed to fit either a left-handed person or a right-handed person.

The handle may also be formed at an angle relative to the brush head, so that a user's wrist need not conform to the longitudinal axis of the paint brush. The handle may also pivot relative to the brush, thereby giving a user a plurality of options for positioning of the brush head relative to the handle.

In one embodiment, a handle is coupled to a brush head using at least one groove-and-tab connector. The groove-and-tab connector could be configured to permit coupling of the handle and brush head in a number of positions.

In another embodiment of the present invention, a handle is coupled to a brush head using a selectable engagement device. The selectable engagement device has a first position wherein the brush head can be engaged or disengaged from the handle. The selectable engagement device also has a second position wherein the brush head can be locked in place relative to the handle.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
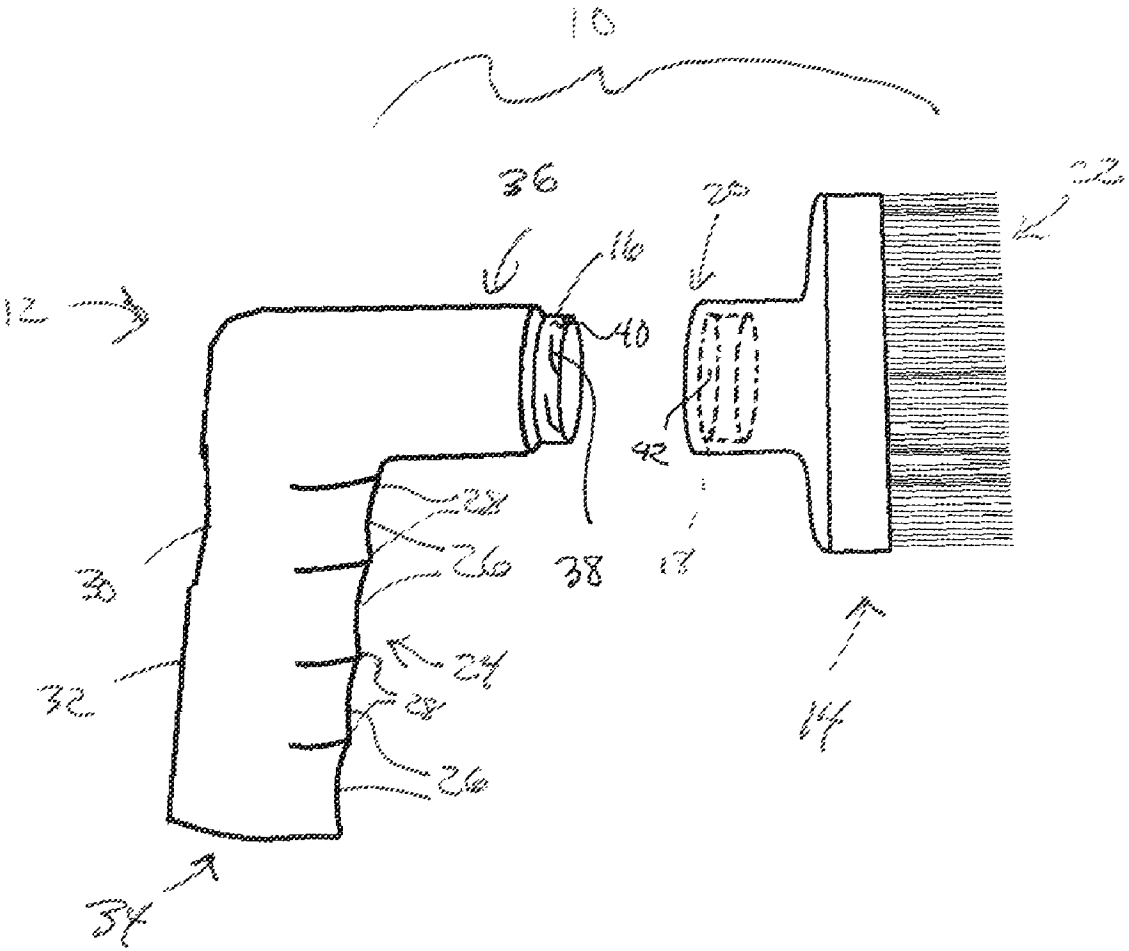
FIG. 1 is an elevation view of a paint brush having a handle that is detachable and a brush head.

FIG. 1 illustrates a paint brush apparatus 10 having a handle 12 and a brush head 14. Handle 12 is illustratively formed to have a protrusion 16 that is configured to mate with recess 18 formed in connecting end 20 of brush head 14. Brush head 14 also has a brush end 22 that provides filaments or hairs for use in applying paint to a surface. It should be understood that although the illustrations show a fairly broad brush of a width considerably larger than that of the handle 12, other brush head shapes and modifications are within the scope of the disclosure, and brush head 14 may have a differently shaped or smaller profile. In addition, other materials may be substituted for brush head 14, such as foam applicators, cloth applicators, sponges, and the like.

Handle 12 illustratively includes a contoured finger-grip surface 24 having a plurality of finger-receiving recesses 26. In the illustrated embodiment, finger-receiving recesses 26 cooperate with a plurality of rims 28 positioned therebetween so as to form a grip that is comfortable and substantially conforms to the contours of a human hand. As illustrated, a contoured surface 30 may also be provided on the palm-side surface 32 of handle 12. Handle 12 may also be configured to fit either a left-handed grip or a right-handed grip by having an exterior surface that is contoured to the corresponding grip.

Although FIG. 1 shows a handle 12 that is substantially formed in a 90-degree angle, it should be understood that other configurations are within the scope of the disclosure. Such configurations may be implemented as required by the particular use. For example, it may be advantageous for a handle 12 to have a less than 90-degree angle in certain applications. This configuration may be desirable for greater comfort, and/or for ease in accessing the area to be painted. In the alternative, handle 12 may be configured to have a pivotable angle (not shown), which would allow for a range of angles between grip portion 34 and engagement portion 36.

In the embodiment illustrated in FIG. 1, protrusion 16 is cylindrically shaped and has a smaller outer diameter than engagement portion 36. Protrusion 16 extends outwardly away from engagement portion 36 a sufficient length to permit a secure connection between male protrusion 16 and female connecting end 20 of brush head 14.

Connecting end 20 of brush head 14 is illustratively formed to have a cylindrically shaped recess 18, the recess being configured to receive male protrusion 16. Protrusion 16 has at least one groove 38 formed in the external surface 40 of protrusion 16. Groove 38 is configured to receive a tab 42 that is illustratively positioned on the interior of cylindrically shaped recess 18. Multiple tabs 42 may also be placed along the interior of cylindrically shaped recess 18 in order to mate with a protrusion having a plurality of grooves 38. Of course, it should be understood that paint brush apparatus 10 may be configured such that protrusion 16 is located on brush head 14 and recess 18 is located on handle 12.

If a plurality of groove 38 and tab 42 combinations are used, as shown in FIG. 1, brush head 14 can be connectable with handle 12 in a number of orientations. For example, brush head 14 could be aligned with handle 12 in the manner shown in FIG. 1, where brush head 14 is substantially co-planar with handle 12. In the alternative, however, brush head 14 could be rotated relative to handle 12 such that tabs 42 each align with a different groove, permitting alignments of brush head 14 and handle 12 that are not co-planar. Such varying alignments may be desirable for projects which are better facilitated by having a different angle of attack for the brush head 14.

Figure 2:
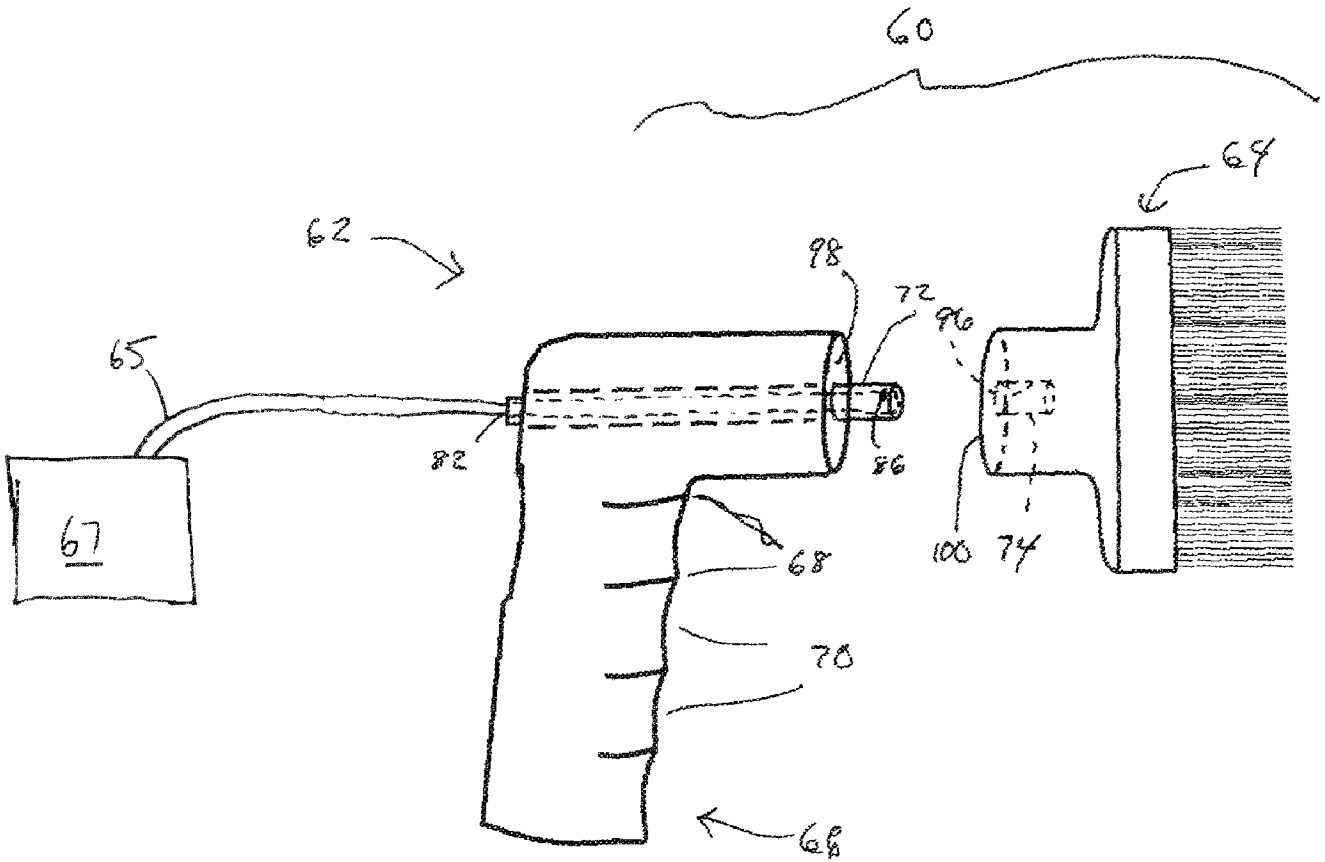
FIG. 2 is an elevation view of another embodiment of a paint brush having a handle that is detachable and a brush head.

Another embodiment is shown in FIG. 2, wherein a paint brush apparatus 60 comprises a handle 62 and a brush head 64. In the embodiment shown in FIG. 2, a grip portion 66 can be configured similarly to grip portion 34 of handle 12 in FIG. 1. For example, grip portion 66 of FIG. 2 may include finger-receiving recesses 70 that are bounded by rims 68. Furthermore, grip portion 66 may be configured to fit either a left hand or a right hand of a user.

Figure 3:
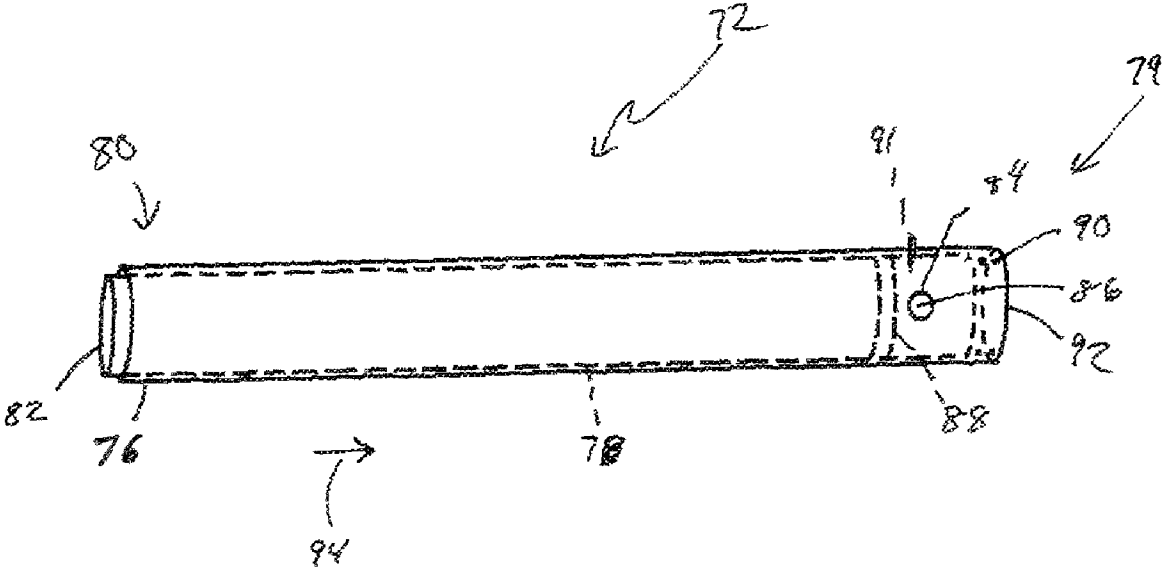
FIG. 3 is an elevation view of a selectable engagement device useful in detachably securing the paint brush handle to the brush head.

In the embodiment disclosed in FIG. 2, handle 62 and brush head 64 are connectable via selectable engagement device 72 and receiver 74. Selectable engagement device 72 is illustratively a cylindrical tube 76 having a movable rod 78 disposed therein, as can be seen in FIG. 3. Selectable engagement device 72 has a button end 80 housing a button 82 (visible in FIGS. 2 and 3). In the illustrated embodiment, button 82 is an exposed end of movable rod 78. The opposite, engagement end 79 of selectable engagement device 72 is enclosed and contains at least one aperture 84. A ball bearing 86 is positioned inside cylindrical tube 76 such that a portion of the ball bearing 86 extends outwardly through aperture 84. Outer surface 91 of rod 78 engages ball bearing 86, holding it in place against aperture 84.

A chamber 88 circumscribes rod 78, and a spring 90 is positioned between end cap 92 of cylindrical tube 76 and rod 78, thereby maintaining a bias against rod 78 to naturally predispose rod 78 in the position shown in FIG. 3. When button 82 is depressed, rod 78 moves in the direction indicated by arrow 94, depressing spring 90 against end cap 92. Such movement aligns chamber 88 with aperture 84, thereby allowing ball bearing 86 to partially recess inside chamber 88 and thereby not protrude as far through aperture 84. In this position, selectable engagement device 72 can be engaged or disengaged with receiver 74. Once selectable engagement device 72 is engaged with receiver 74 (and therefore handle 62 and brush head 64 are engaged), button 82 can be released, so as to cause ball bearing 86 to engage an inner surface 96 of receiver 74. In order to accommodate ball bearing 86, inner surface 96 may be fitted with a chamber or dimple (not shown) that receives ball bearing 86, or any similar type of construction that permits a locking engagement between selectable engagement device 72 and receiver 74. It is also contemplated that inner surface 96 may alternatively be formed of a malleable or other type of material that would allow for ball bearing 86 to imbed in inner surface 96 and thereby retain selectable engagement device 72 inside receiver 74.

A positioner (not shown) may also be used to facilitate engagement between handle 62 and brush head 64. Such a positioner may comprise, for example, matching engageable teeth that are formed on each of the surfaces of the handle 62 and brush head 64. The engageable teeth would be positioned such that when handle 62 and brush head 64 are engaged, the teeth would engage and therefore lock the rotational position of the brush head 64 in place relative to handle 62. The teeth may be positioned, for example, on engagement surface 98 of handle 62 and on the opposing engagement surface 100 of brush head 64. Another alternative construction is to place the teeth on or near end cap 92 of selectable engagement device 72, and mating teeth inside receiver 74.

In either embodiment, it may further be desirable to incorporate a paint feed tube, or some other means of introducing paint to the brush head. For example, it may be desirable to have a paint feed tube that passes through the handle to feed paint to the paint brush head. The paint feed tube (see, e.g., paint feed tube 65 in FIG. 2) may be connected to a paint supply, or even a pressurized paint supply (see, e.g., pressurized paint supply 67 in FIG. 2), that would provide a constant source of paint to the brush head. In the embodiment shown in FIGS. 2 and 3, such a paint feed tube may be configured to pass through the center of rod 78. However, other configurations are within the scope of the disclosure.

In yet another embodiment, a paint brush handle 100 and heads 102, 104, 105 are disclosed in FIGS. 4-8. Paint brush handle 100 is illustratively formed of two substantially symmetric halves 106, 108, and the two halves are fastened with at least one fastener. A grip coating 110 is also disclosed, the grip being of a material that provides both comfort and utility as a grip. Such a material for the grip coating 110, for example, may be a polymer or rubberized type of material that is long-lasting and durable, yet has some flexibility so as to feel comfortable in the hand.

Figure 4:
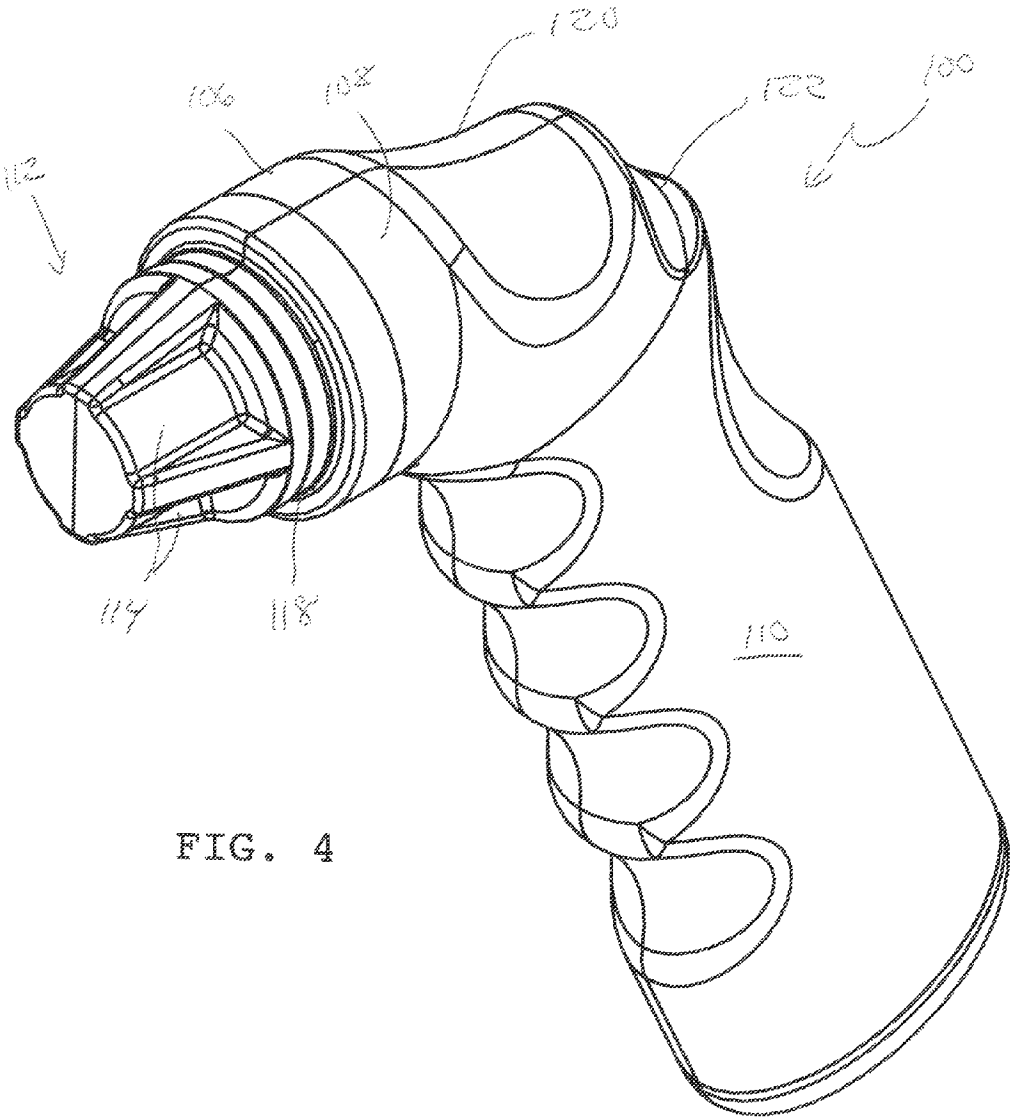
FIG. 4 is a perspective view of another embodiment of the paint brush handle of the present invention.
Figure 5:
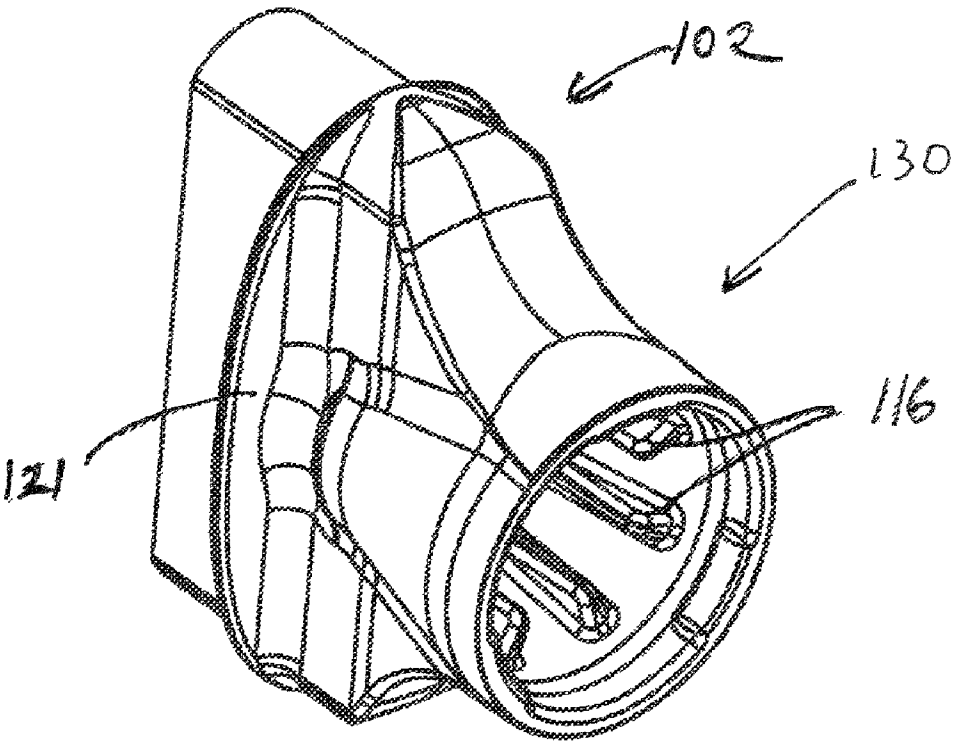
FIG. 5 is a perspective view of another embodiment of the paint brush head associated with the present invention.
Figure 6:
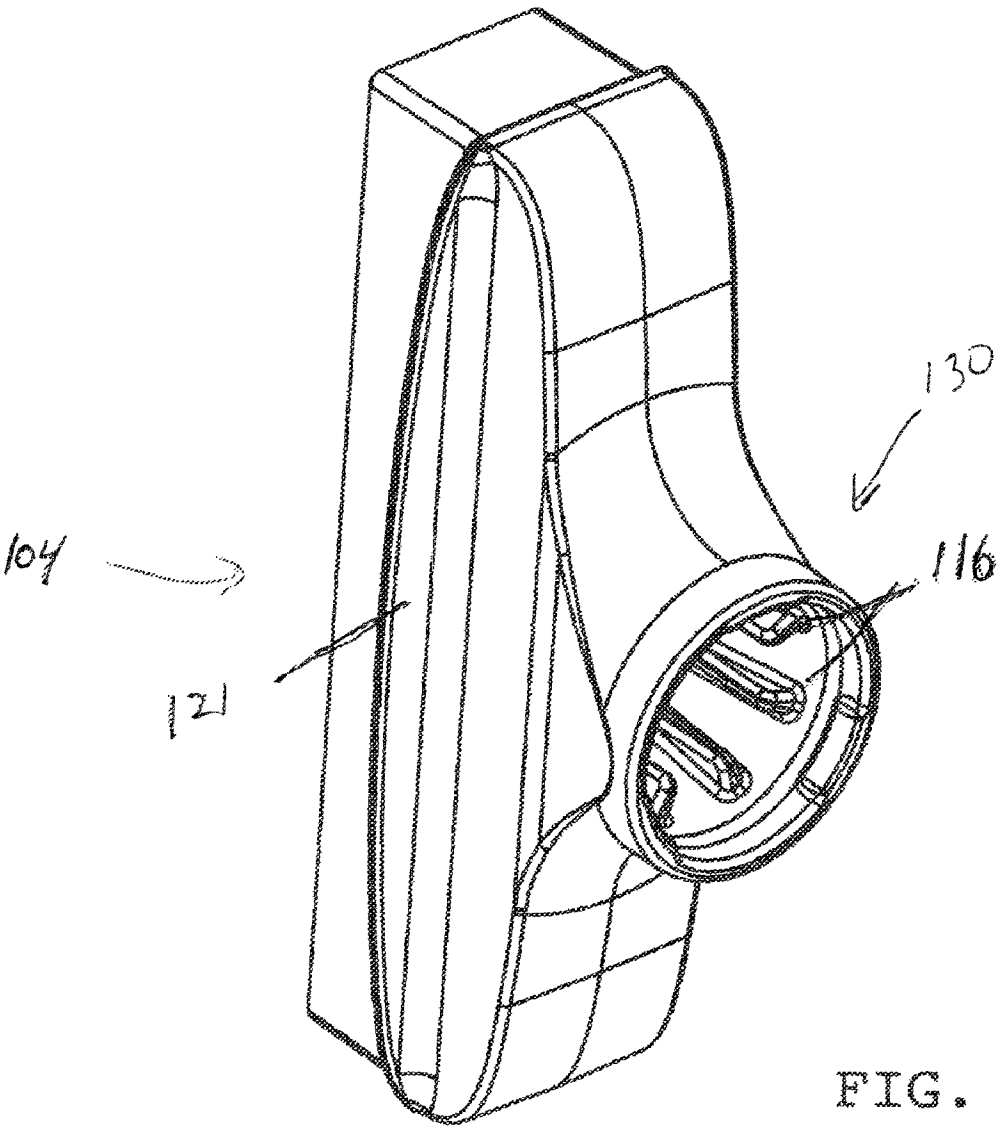
FIG. 6 is a perspective view of yet another embodiment of the paint brush head associated with the present invention.
Figure 7:
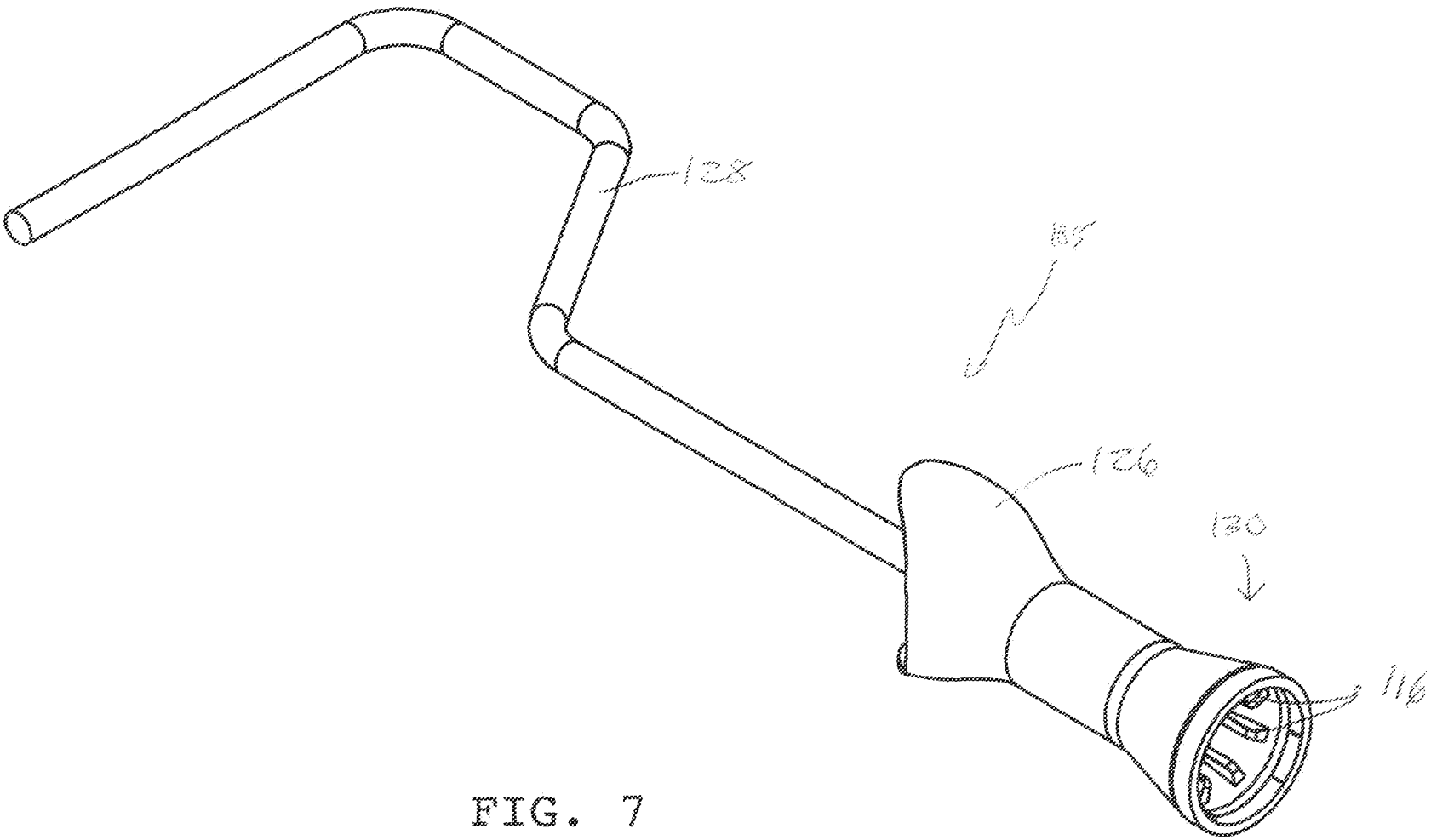
FIG. 7 is a perspective view of a paint brush roller head associated with the present invention.

As shown in FIG. 4, handle 100 can be configured to have an engagement portion 112 that mates with receiving portion 130 of brush heads 102, 104, 105, shown in FIGS. 5-7. Illustratively, engagement portion 112 has recesses 114 that can mate with tabs 116 of brush heads 102, 104, or 105. Recesses 114 cooperate with tabs 116 to create a mating relationship between handle 100 and a selected one of heads 102, 104, 105 such that head 102, 104 or 105 does not rotate relative to handle 100 when handle 100 and head 102 are engaged. Handle 100 also has a rim 118 that interlocks with head 102 to maintain the engagement between handle 100 and head 102.

Figure 8:
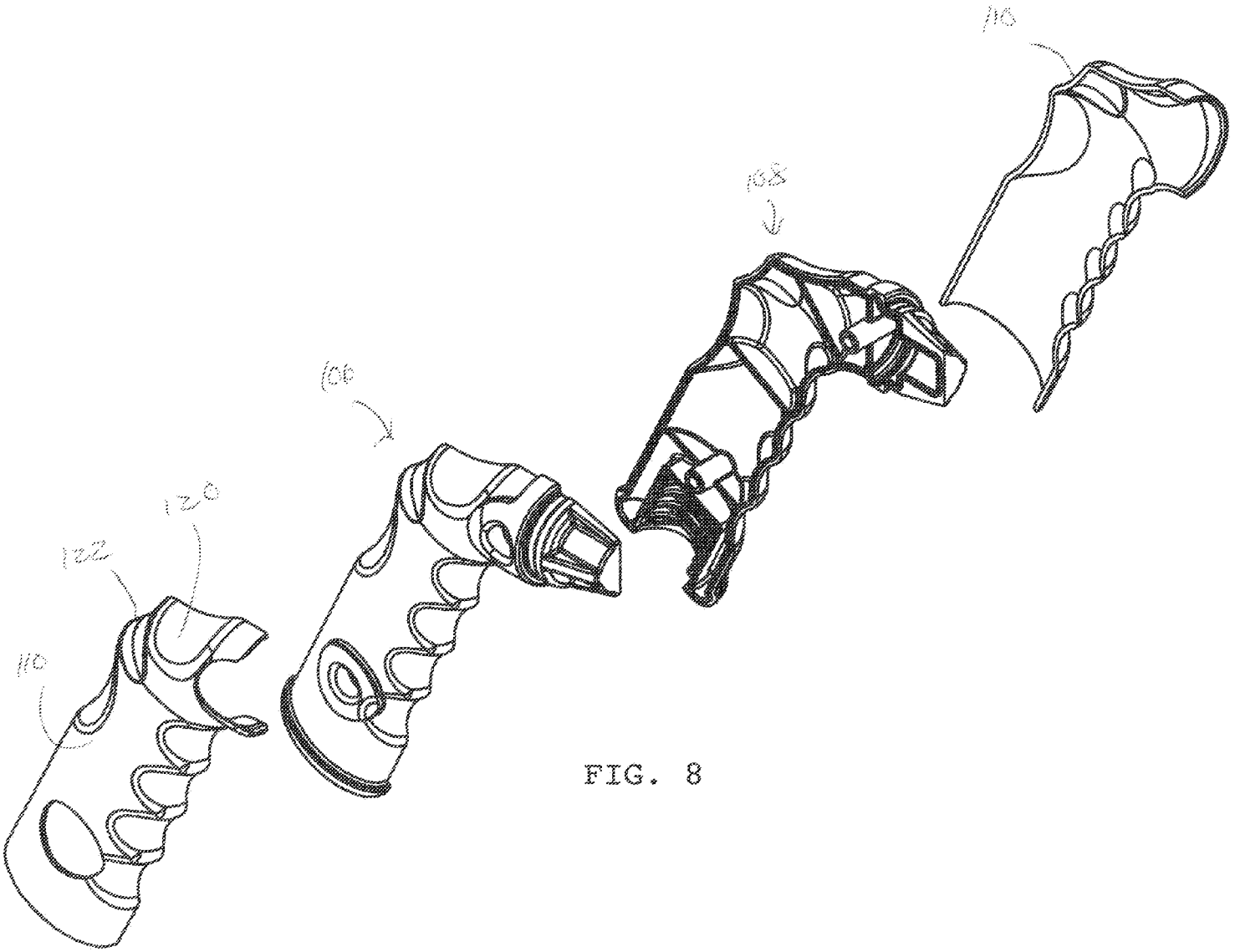
FIG. 8 is an exploded assembly view of a paint brush handle.

As can be seen in FIGS. 4 and 8, handle 100 is illustratively configured to include a first thumb notch 120 and a second thumb notch 122. The alternative positions for the thumb in notch 120 or 122 allows for a range of hand sizes and/or a range of desired grips for a user.

FIG. 5 is an example of one type of paint brush head 102 that can be engaged with handle 100. In the example shown in FIG. 5, paint brush head 102 holds a two inch paint brush. Such a two inch paint brush is well known in the art, and is readily formed and attached to head 102 via staples, glue, or any other type of fastener.

Yet another type of paint brush head 104 is shown in FIG. 6, wherein the paint brush head 104 holds a four inch brush. In the illustrated embodiments shown in FIGS. 5 and 6, brush heads 102 and 104 each include a protrusion 121 that provides a lip to facilitate easy detachment from handle 100.

It is contemplated that a roller head 105, such as that shown in FIG. 7, may also be attached to handle 100. Roller head 105 may include a paint catch 126 that functions to prevent paint from running down support 128 and on to handle 100. Illustratively, support 128 is made of metal and is attached to a plastic head 105. Similar to paint brush heads 102, 104, roller head 105 has a receiving portion 130 that engages engagement portion 112 of handle 100.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure.

There is a plurality of advantages of the present invention arising from the various features of the paint brush described herein. It will be noted that alternative embodiments of the paint brush of the present invention may not include all of the features described yet still benefit from at least some of the advantages of such features. Those of ordinary skill in the art may readily devise their own implementations of a paint brush that incorporate one or more of the features of the present invention.

What is claimed is:

1. A paint brush comprising:

a handle having a grip portion with plurality of finger-receiving contours and a brush-head engagement portion integrally formed with the grip portion, the brush-head engagement portion defining an axis that is at an angle relative to the grip portion;

a brush head having a receiving portion for receiving the brush-head engagement portion of the handle;

wherein:

the handle is engageable with the brush head in a plurality of radial angles relative to the axis defined by the engagement portion; and a connection mechanism coupling the handle to the brush head and including a quick release capable of being manipulated to release the brush head from the handle and capable of being manipulated to permit a rotation of the brush head relative to the handle without the brush head being released from the handle.

2. The paint brush of claim 1, wherein the brush head further comprises is a two inch brush.

3. The paint brush of claim 1, wherein the brush head further comprises a four inch brush.

4. The paint brush of claim 1, wherein the brush head further comprises a roller.

5. An apparatus comprising:

a paint applicator member coupled to a paint applicator handle;

a connection mechanism coupling the paint applicator member to the paint applicator handle, the connection mechanism including a stem extending from the paint applicator handle, a receiving member located within the paint applicator member, and a quick release capable of being manipulated to release the paint applicator member from the paint applicator handle; and wherein:

the quick release is retained with one of the paint applicator member and paint applicator handle when it is manipulated to release the paint applicator member from the paint applicator handle;

the paint applicator member can be rotated to a plurality of orientations relative to the paint applicator handle; and the quick release is further capable of being manipulated to permit a rotation of the paint applicator member relative to the paint applicator handle without the paint applicator member being released from the paint applicator handle.

6. The apparatus of claim 5 wherein the paint applicator member is capable of being positioned at a plurality of orientations when the quick release is not manipulated to release the paint applicator member from the paint applicator handle.

7. The apparatus of claim 5, wherein the quick release is a button capable of being depressed to release the paint applicator member.

8. The apparatus of claim 5, wherein the connection mechanism includes at least one protrusion operable to be received by a protrusion bearing surface.

9. The apparatus of claim 8, wherein the connection mechanism further includes an extension capable of being engaged with a receptacle, the at least one protrusion movable when the quick release is manipulated to a disengaged position.

10. The apparatus of claim 9, wherein the paint applicator member includes the at least one protrusion and the paint applicator handle includes the protrusion bearing surface.

11. The apparatus of claim 5, wherein the paint applicator member can be any one of a brush head, a roller, a pad, a cloth, and a sponge.

12. An apparatus comprising:

a replaceable paint applicator having a surface capable of applying paint to a painting surface;

a handle that can be selectively engaged and disengaged with the replaceable paint applicator; and a retention selector disposed within the handle and protruding from an end of the handle, wherein the retention selector is configured to be inserted into the replaceable paint applicator, and wherein the retention selector is moveable between a first position and a second position and is capable of releasing the replaceable paint applicator from a locked engagement position against the end of the handle so that the replaceable paint applicator can be separated from the handle, wherein the handle is capable of being engaged but not lockingly engaged with the replaceable paint applicator, and wherein the replaceable paint applicator can be changed from a first angular orientation to a second angular orientation when the replaceable paint applicator is engaged with the handle.

13. The apparatus of claim 12, which further includes an energy member configured to provide a force to the retention selector when the selector is conveyed from the first position to the second position.

14. The apparatus of claim 13, which further includes a locking device that secures the replaceable paint applicator to the handle and is operable to be delocked when the retention selector energizes the energy member.

15. The apparatus of claim 14, wherein the energy member is a spring and the locking device is a ball bearing.

16. The apparatus of claim 12, wherein the retention selector includes a button capable of being depressed to release the replaceable paint applicator from the handle.

17. The apparatus of claim 12, which further includes a paint pressure supply and a feed tube, the paint pressure supply operable to displace paint toward the replaceable paint applicator.

18. The apparatus of claim 12, which further includes means for gripping the handle, wherein the means can be selected from at least one of a grip-coating and a thumb notch.

19. An apparatus comprising:

a paint handle and a paint applicator capable of being releasably coupled and engagable in a plurality of radial angles; and means for receiving a depressive force to decouple the paint applicator from the paint handle and for permitting a rotation of the paint applicator relative to the paint handle without the paint applicator being released from the paint handle.

* * * * *